United States Patent [19]

LaVelle et al.

[11] Patent Number: 4,920,589

[45] Date of Patent: May 1, 1990

[54] THERAPEUTIC TABLE

[75] Inventors: Richard E. LaVelle, Olympia Fields; Gary L. Wood, Park Forest; Kevin P. Morrey, Richton Park; Clayton E. Bossert, Aurora, all of Ill.

[73] Assignee: Thomas J. Ring, Palos Heights, Ill.

[21] Appl. No.: 724,405

[22] Filed: Apr. 17, 1985

[30] Foreign Application Priority Data

Aug. 24, 1983 [WO] PCT Int'l Appl. ..... PCT/US83/01298

[51] Int. Cl.[5] ..... A61G 7/10

[52] U.S. Cl. ..... 5/61; 5/62

[58] Field of Search ..... 5/61-66; 128/242, 33, 71-73, 80 C, 84 A, 84 B, 85, 134; 269/323, 328; 248/295.1, 298

[56] References Cited

U.S. PATENT DOCUMENTS

| | | | |
|---|---|---|---|
| 1,328,802 | 1/1920 | Anderson | 5/62 |
| 1,740,906 | 12/1929 | Rathauszky | 5/61 |
| 2,009,270 | 7/1935 | Mayer | 128/24 R |
| 2,067,891 | 1/1937 | Comper | 269/328 |
| 2,177,341 | 10/1939 | Demcak | 269/328 |
| 2,647,026 | 7/1953 | Shampaine | 5/66 |
| 3,050,745 | 8/1962 | Tabbert | 5/62 |
| 3,132,351 | 5/1964 | Huntress et al. | 5/63 |
| 3,220,019 | 11/1965 | Nelson | 5/62 |
| 3,247,528 | 4/1966 | Swenson et al. | 5/62 |
| 3,381,684 | 5/1968 | Anderson | 269/328 |
| 3,434,165 | 3/1969 | Keane | 5/61 |
| 3,609,778 | 10/1971 | Zeiner | 5/82 R |
| 3,650,523 | 3/1972 | Darby, Jr. | 128/134 |
| 3,711,876 | 1/1973 | Kirkland | 5/62 |
| 3,737,924 | 6/1973 | Davis | 5/108 |
| 3,793,652 | 2/1974 | Linehan et al. | 5/63 |
| 3,913,153 | 10/1975 | Adams et al. | 5/68 |
| 3,941,365 | 3/1976 | Frymoyer | 269/325 |
| 4,071,916 | 2/1978 | Nelson | 5/62 |
| 4,107,490 | 8/1978 | Keane | 5/61 |
| 4,175,550 | 11/1979 | Leininger | 128/24 R |
| 4,181,297 | 1/1980 | Nichols | 269/328 |
| 4,194,499 | 3/1980 | Donnelly, Jr. | 128/24 R |
| 4,256,095 | 3/1981 | Graham | 128/24 R |
| 4,407,277 | 10/1983 | Ellison | 128/82 |
| 4,432,353 | 2/1984 | Vrzalik | 128/24 R |
| 4,435,862 | 3/1984 | King et al. | 5/66 |
| 4,472,845 | 9/1984 | Chivetta et al. | 5/63 |
| 4,541,134 | 9/1985 | Black et al. | 5/118 |

FOREIGN PATENT DOCUMENTS

| | | | |
|---|---|---|---|
| 2854142 | 6/1980 | Fed. Rep. of Germany | 5/62 |
| 1059100 | 2/1967 | United Kingdom | 5/61 |
| 2088328A | 6/1982 | United Kingdom | 5/62 |

*Primary Examiner*—David A. Scherbel
*Assistant Examiner*—Michele A. Van Patten
*Attorney, Agent, or Firm*—Thomas J. Ring

[57] ABSTRACT

A kinetic therapeutic table 10 having a frame 12, a planar patient support 14 mounted to the frame 12 for rotation about an elongate axis substantially aligned therewith and adjustable vertically at its foot 20 and head 18 ends. Symmetrical lateral support packs 114 at opposite sides of the patient's torso have laterally offset mountings for adjustment of the width therebetween by reversing their locations. Outer lateral leg supports 110 are mounted to the frame 12 and have a track 184 at their top surface fo slideable mounting of both knee restraints 182 and foot supports 202 at selected positions therealong. The patient support 14 comprises a planar frame with a plurality of panels 88 removably mounted thereto by means of pins 96 actuated by a lever arm 100. A patient support 14 drive motor 28 provides rotary drive to the patient support 14 through a worm gear 40 locked to a gear linkage, so that it may be stopped and held by the worm gear 40 in any angular position by switching power off to the motor 28. The worm gear 40 is manually disengageable from the remainder of the gear linkage to enable manual movement of the patient support 14 to a horizontal position. A locking pin 76 is automatically biased against a drive ring 22 and springs into a pin hole 78 therein when the horizontal position is reached. The patient support 14 is mounted at one end of its pivot axis to the frame 12 by a ball 19 and socket 21 connection. The other end is connected to the drive ring 22 which is rotatably mounted to the frame 12 by means of idler wheels 26 and is otherwise rotatably driven by the motor 28 through the gear linkage. A electronic control circuit controls application of power to the motor 28 for selectively adjustable periodic movement of the patient support 14.

10 Claims, 9 Drawing Sheets

IV
IV
10
12
14
15
16
17
18
19
20
21
24
158
159
160
162
164
166
172
174
176
178
184
186
204
208
210
214
216
218
224
226
228
230
232
233
234
236
238
240
242
244
246
248
250
252
254
255
256
258
260
262
266
270
272
274
276

FIG. 6
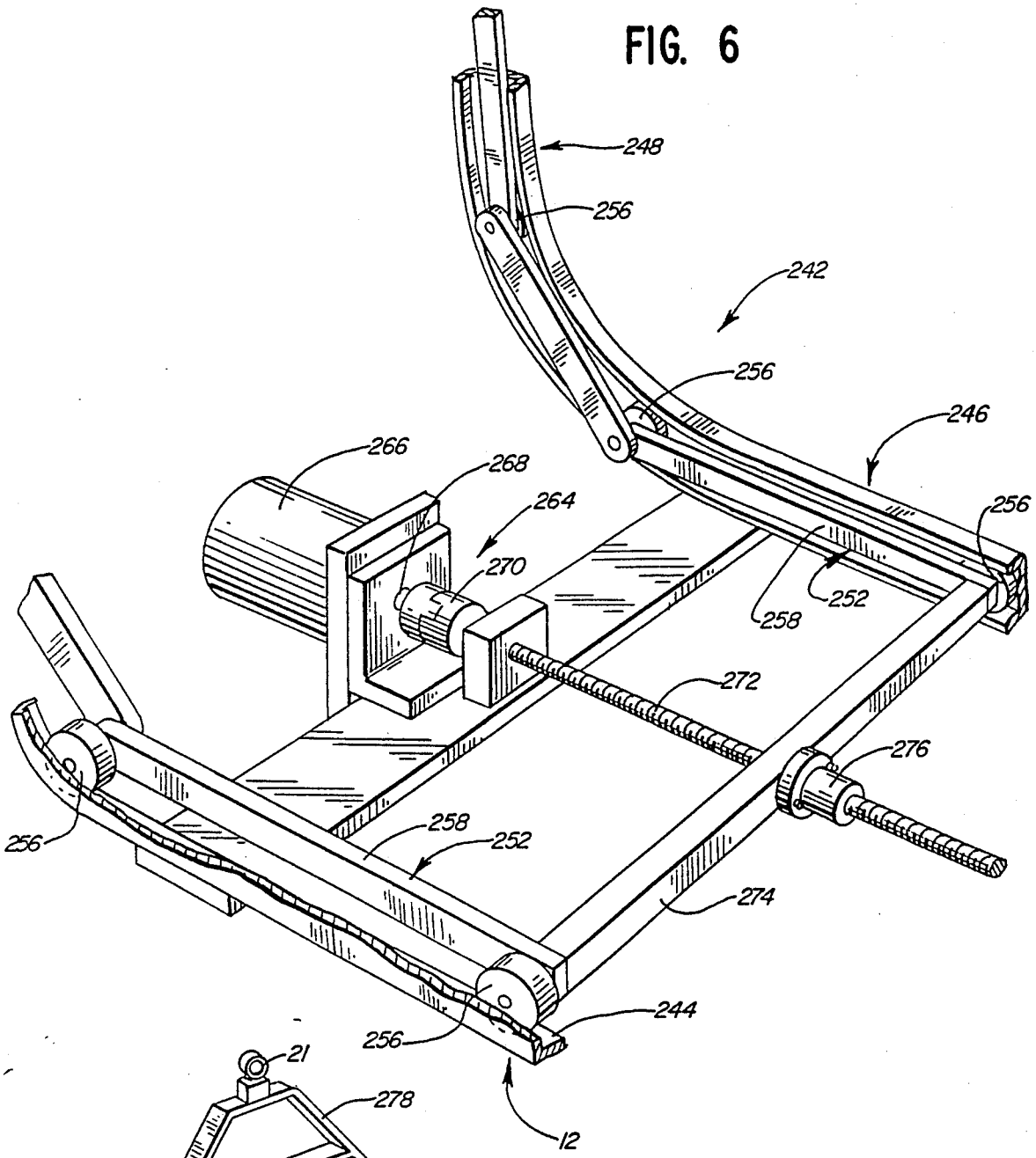
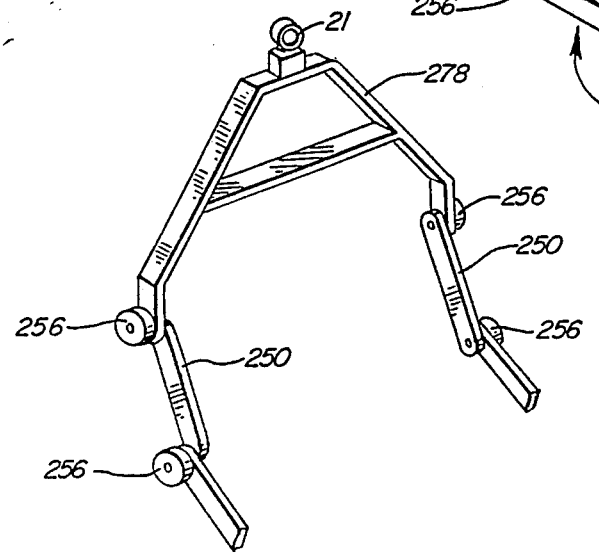
FIG. 6A

THERAPEUTIC TABLE

BACKGROUND OF THE INVENTION

This invention relates to therapeutic tables, or beds, and more particularly, to a kinetic therapeutic table which reciprocally rotates a patient support from one side to the other and which is otherwise adjustable.

Kinetic therapeutic tables which slowly, reciprocally rotate a patient support to cause different parts of the patient's anatomy to support his weight are well known. Such kinetic therapeutic tables are intended for use by patients who are incapable of substantial voluntary movements. The voluntary movements needed to eliminate the formation of bedsores, lung congestion, venal thrombosis and other maladies which develop from immobility are substituted by periodic movements of the therapeutic table. Examples of such therapeutic tables are shown in U.S. Pat. Nos. 2,076,675 (Sharp); 2,950,715 (Brobeck); 3,434,165 (Keane); 3,748,666 (Seng); 4,107,490 (Keane); 4,175,550 (Leininger et al.) and 4,277,857 (Svehaug).

Since the patient support is tilted, it is necessary to provide lateral support to secure the patient against falling off the bed. The lateral supports must fit snugly to the patient's body and must therefore be adjustable for proper fit with various patients of different size. In the bed of Keane 3,434,165, elongate, upstanding side members provide lateral support. These are mounted by means of depending shafts which fit into tubular receivers, or mountings, which in turn are fastened to the underlying patient support. While the tubular receivers are laterally adjustable, the location of the inner side of the lateral support which presses against the patient is not adjustable relative to the tubular mountings.

In addition to lateral support, it is also sometimes necessary to provide means for restraining the patient's knee against movement above the patient support and means to support the patient's foot. In patent No. 3,434,165 (Keane), for instance, such a knee restraint and foot support are mounted to the ends of separate L-shaped members which are mounted to, and extend upwardly from, a central portion of the frame to which the patient support is mounted. This inconveniently also places the adjustment mechanisms for the knee restraint and the foot support in the central portion of the table where it is relatively more difficult to reach by attendants, particularly if they are of short stature. In addition, this central protrusion requires the patient support to be centrally divided.

It is also known to provide the patient support in the form of multiple panels which can be individually moved away from beneath the patient to gain access for treatment, bathing or the like. In Keane 3,434,165 these panels are hinged to a central portion of the frame. Thus, although the panels are movable for access, they are not easily removable entirely from the frame. Such non-removability is desirable for cleaning of the panel and for better access and for situations in which the panel is not needed for supporting the patient, as in the case of an amputee. In addition, complete removability permits easy substitution of special purpose panels which may be required.

For purposes of improving access to the patient, it is also desirable to stop the movement of the bed at any selected non-horizontal position. However, it is also necessary to quickly move the bed to a horizontal position in the event of an emergency. It is also important to be able to switch off power to the motor which provides the rotary drive to the motor at any angular position of the bed in the event of shorting or other malfunction of the motor. In Keane 4,107,490, a power off switch is provided in a kinetic therapeutic table, but it is mechanically prevented from being activated to terminate power to the rotary drive motor except when the bed is in one of certain preselected positions. Once locked in one of these positions, the bed can only be moved to a horizontal position by disengaging the patient support from the drive by means unassociated with the position locking means.

A further problem with known kinetic therapeutic beds which move the patient about a pivot axis aligned with the elongate axis of the table is that the patient support is located beneath the pivot axis. Accordingly, instead of the patient support rotating, it unpleasantly swings or sways. It is known to provide a pivot axis aligned with the patient support in a therapeutic table which tilts or rocks about an axis transverse to the elongate direction of the patient support, as shown in U.S. Pat. No. 4,277,857. However, the problem is not alleviated, since the patient's head and feet are still caused to swing because of their substantial distance from the pivot axis. In known therapeutic tables which rotate about an axis aligned with the elongate direction of the pivot axis, such as shown in (Keane) 3,434,165 and (Leininger et al.) 4,175,550, the pivot axis is undesirably located above the patient support.

A movable drive support is needed to mount the patient support for rotary movement relative to the frame which provides a smooth and steady movement with minimum noise. In the aforementioned beds, the patient supports are simply mounted to narrow pivot axles at opposite ends. This disadvantageously places all the weight of the patient and patient support on the narrow axles. If the narrow pivot axles are driven directly, they provide little mechanical advantage. If the bed is driven by an eccentic cam spaced from the axle, then non-uniform drive movement is developed. In U.S. Pat. No. 3,302,218 (Stryker), a rotatable bed is shown supported by an annular member, but no drive is associated with the annular member, and it is disadvantageously located intermediate the ends of the patient support.

In addition to rotary movement about an elongate axis, it is also desirable to be able to pivot or tilt the bed about an axis extending substantially transverse to the rotary axis. When the patient is tilted to a position with his head at a level beneath the level of his feet, the patient is said to be in a Trendelenburg position, and when he is in a position with his feet lower than his head, he is in a reverse Trendelenburg position. Devices which provide for this type of movement for a patient support are known as illustrated by U.S. Pat. Nos. 2,076,675 (Sharp); 3,434,165 (Keane); 3,525,308 (Koopmans et al.) and 4,277,857 (Svehaug). In Sharp 2,076,675 and Keane 3,325,308 the beds also rotate. In the device of Svehaug 4,277,857, a diagonal track provided at opposite ends of the bed is employed to alternately raise and lower the two ends. However, a single drive is provided for continuous rocking movement of the patient support, and independent control of movement of the two ends of the bed is not obtainable. Generally, while known devices perform somewhat satisfactorily, they employ structure which have a high profile or are unduly heavy or mechanically complex.

It is also desirable to adjust the degree of maximum tilt imparted to the patient support. In known therapeutic tables such adjustment is limited to a few selected discrete angles of tilt and such adjustment is accomplished by mechanical means.

SUMMARY OF THE INVENTION

Thus, the principal object of the present invention is to provide an improved kinetic therapeutic table which overcomes the disadvantages in prior therapeutic tables and the like noted above.

In keeping with this objective, a therapeutic table having a frame and an elongate patient support mounted to the frame is provided with an improved adjustable lateral support assembly for holding a portion of the patient's body against lateral movement. The assembly comprises an elongate lateral support member which is substantially symmetrical with respect to an elongate central axis thereof, a mounting member attached to the support member and having a connection portion at a location offset laterally from the central axis, and means for releasibly attaching the connection portion of the mounting member to the bed. Preferably, the releasible attaching means is also adjustably mounted, so that the position of the lateral support member can be laterally adjusted for patients of different size. The adjustable lateral support assembly of the invention provides an additional degree of adjustment. Adjustment is achieved by disconnecting a pair of substantially identical, lateral support members from the bed and then reconnecting them to the bed in the opposite positions that they were previously connected, with their previously inwardly facing sides facing outwardly. The pair of lateral support members are mirror images of one another with regard to their offset connection portions. Accordingly, interchanging their positions results in an adjustment of the lateral position of the lateral support member surfaces which are closest to the patient by an amount equal to the lateral offset of the connection portion.

Another important advantageous feature of the present invention is the provision of a therapeutic table having an improved knee restraint assembly which more conveniently places the adjustment mechanism therefore adjacent the side of the bed, rather than closer to the central portion of the bed which makes access more difficult. This also avoids the placement of a mounting bracket protruding centrally from the patient support. The improved knee restraint assembly comprises a knee restraint member, means for mounting the knee restraint member to a lateral support member in a position overlying a knee area of the patient's support and means for mounting the lateral support member to the frame. The lateral support member is located alongside the bed rather than in a central portion. Advantageously, it serves the dual functions of providing lateral support to a patient and providing a mounting means for the knee restraint member.

In keeping with the advantages obtained in the foregoing knee restraint assembly, the objective of the present invention is also partially achieved by means of provision of an improved foot support assembly in a therapeutic table. Like the knee restraint assembly, the foot support assembly employs the lateral support member for mounting purposes. The improved foot support assembly of the invention comprises a foot support member for supporting a patient's foot, means for mounting the foot support member to the lateral support member and means for mounting the lateral support member to the frame. Thus, when both knee restraint and foot support members are provided, the lateral support member serves triple functions of laterally supporting the patient, mounting the foot support member and mounting the knee restraint member. In a preferred embodiment, a single track is attached to the top surface of the lateral support, and this single track is used for adjustably mounting both the foot support and knee restraint members at selected fixed positions therealong.

The objective of providing an improved therapeutic table is further achieved in the present invention through means of an improved panel mounting mechanism for a plurality of panels which compose the patient's support. Unlike known therapeutic tables comprised of a plurality of panels in which the panels are movable for access but not removable, in the present invention the improved panel mounting mechanism provides for easy and complete removal of the panels to facilitate access and cleaning. In addition, the improved mounting mechanism provides for easy substitution of one panel mounting mechanism for another. Briefly, the improved panel mounting mechanism comprises a connector member mounted to one of the frame and one side of the panel, means connected to the other of the frame and the one side of the panel for receipt of the connector member for support of the panel at that one side, another connector member, means for mounting the other connector member to the panel adjacent another side thereof for movement relative to the panel, means connected to the frame for receipt of the movably mounted connector members to support the panel at the other side and means connected with the movable connector member and manually engageable to move the movable connector member into and out of supportive receipt within the movable connector member supporting means. In a preferred embodiment, a pair of pins and a pair of movable pins are provided as connector members, and a single handle is used both to effectuate the movable pin removal and to serve as a handle for holding the panel during its removal. In this preferred embodiment, the method of removing the panel, comprises the steps of actuating the handle to move the movable pin out of supportive connection with the frame and holding the panel by the handle while moving the panel away from the frame to move the other pin out of supportive connection with the frame.

The objective of providing an improved kinetic therapeutic bed is additionally achieved by means of an improved drive control assembly which, in addition to providing rotary drive for the patient support, will also hold the patient support in any selected position for improved access to the patient. In addition, means are provided for quickly releasing the hold on the patient support to enable prompt movement thereof to a horizontal position in the event of an emergency. The improved drive control assembly of the present invention thus comprises means engageable with a motor through a unidirectional driving gear and connected with the patient support for transmitting the power from the motor to rotate the patient support, means for moving the motor and power transmitting means into and out of engagement with one another and a switch for terminating electrical power to and stopping the rotation of the motor at any position of the patient's support. The unidirectional driving gear and power transmitting means act together when engaged to hold the patient support at any position it is in when the motor stops. Disengagement of the power transmitting means and unidirectional driving gear, on the other hand, causes release of the hold on the patient support to enable movement thereof to a substantially horizontal position.

In a preferred embodiment, the drive train employs a driving gear, such as a worm gear, which cannot be driven, so that when the motor is turned off, the one way driving gear is stationary and cannot be turned by forces applied to the patient support. Advantageously, the switch can be actuated at any position of the patient support to stop the bed at any position instead of only at a few preselected positions as in the aforementioned therapeutic tables.

A further advantageous feature of the therapeutic table of the present invention is the provision of an improved drive control assembly which simultaneously provides for disengagement of the motor and drive system to permit manual rotation of the patient support to a horizontal position and for automatic actuation of means for locking the patient support in a preselected position when the motor is disengaged. Specifically, the improved drive control assembly comprises means for disengaging the motor from the patient support to remove rotary power therefrom and stop movement of the patient support, means, when actuated, for locking the patient support in a preselected position and means associated with the disengaging means for actuating the locking means when the motor is disengaged. In a preferred embodiment, movement of a manual lever provide force for both disengaging the motor from the patient support and moving a locking pin, or other member, against a drive ring in the path of a pin hole therein. When the patient support and drive ring are rotated to the horizontal position, then the locking pin springs into the pin hole and prevents further movement of the patient's support until it is removed. The locking pin is automatically removed from the pin hole upon movement of the lever to again engage the motor with the patient support.

Yet a further advantageous feature of the present invention is the provision of a kinetic therapeutic table comprising a substantially planar patient support frame, a patient support mounted to the frame for supporting a patient on a surface thereof and means for mounting the patient support to the frame for rotary movement relative thereto by an elongate pivot axis substantially aligned with the patient support surface. Unlike known therapeutic tables in which the pivot axis is located above the patient support, undesirable swinging movement of the patient support surface is eliminated. In addition, this enables locating the center of gravity of the combined patient and patient support and support frame substantially at the pivot axis to reduce the average moment arm and the amount of power needed to rotate the patient support and patient. In addition, the need for a keel or counterbalance weight is reduced or eliminated which, in turn, permits locating the patient support at a lower height, such as thirty inches, which is more in keeping with the standard height for hospital beds required to facilitate easy access to the patient.

Still another important advantageous feature of the present invention is an improved patient support and drive assembly which rotates the patient support of a kinetic therapeutic bed with a smooth and steady movement and with minimum noise or slippage. These features are achieved in an improved patient support and drive assembly for a therapeutic table comprising a first connector assembly including a pivot axle and a pivot axle connector for pivotally mounting one end of the bed to one end of the frame, a second connector assembly for pivotally mounting the other end of the patient support to the frame including a circular drive ring, means for fixedly attaching the other end of the patient support to the drive ring to rotate therewith and means for mounting the drive ring to the frame for rotary movement relative thereto about an axis of rotation substantially aligned with said pivotal axle and means connected with the drive ring and the frame of the therapeutic table for driving the ring for rotation relative to the frame. In a preferred embodiment, the first connector includes a ball and mating socket for a relative universal movement therebetween and the drive ring has a diameter on the order of the width of the frame to provide a substantial gear reduction relative to the driving means. Preferably, the drive ring mounting means includes an idler wheel mounted to the frame and in underlying supportive engagement with the circumference of the drive ring. Also, in the preferred embodiment, a locking mechanism holds the motor in engagement with the drive train to prevent slippage or hopping and to ensure good smooth uniform motion.

The objective of the present invention is further achieved by provision of an improved adjustable patient support mounting assembly for a therapeutic table having a frame and a patient support. This support mounting assembly is provided to pivot, or tilt, the bed about an axis substantially transverse of the rotary axis or to raise and lower either or both ends of the bed to achieve a Trendelenburg or reverse Trendelenburg position for the patient. The improved assembly comprises a track with a horizontal portion and an upturned portion, a first element movably mounted to the upturn portion of the track for movement therealong, a second element movably mounted to the horizontal portion of the track for movement therealong, means located substantially within the track for flexibly linking the first and second elements, means for driving the second element along the horizontal portion of the track and means for connecting one end of the patient support to the first element for movement therewith. The connecting means moves the one end of the patient support to raise or lower the one end. In a preferred embodiment two such adjustable mounting assemblies are provided at opposite ends of the bed which are individually controllable. This arrangement enables a lower profile for the table and eliminates dangerously accessible linkage arms.

Still a further objective of the present invention is provision of a control for a therapeutic table which enables easy electronic adjustment of the degree of tilt of the patient support to any selected angle. In a preferred embodiment, this is achieved by providing means for establishing a first time period of rotation in one direction, means for establishing a second time period of rotation in the opposite direction and means for controlling the application of power to the drive motor to alternately cause it to rotate in the two opposite directions during the first and second time periods respectively. Each of the two time periods are independently adjustable to achieve any degree of maximum tilt within a preselected range.

BRIEF DESCRIPTION OF THE DRAWINGS

Further objects, features and advantages will be made apparent and the foregoing objects, features and advantages will be described in greater detail in the following detailed description of the preferred embodiment which is given with reference to the several views of the drawing, in which:

FIG. 6 is an enlarged partially broken away perspective view of one adjustable patient support mounting assembly;

FIG. 6A is a partially broken away perspective view of the upper flexible linkage and connector frame of adjustable patient support mounting assembly;

DETAILED DESCRIPTION

Figures 1, 15:
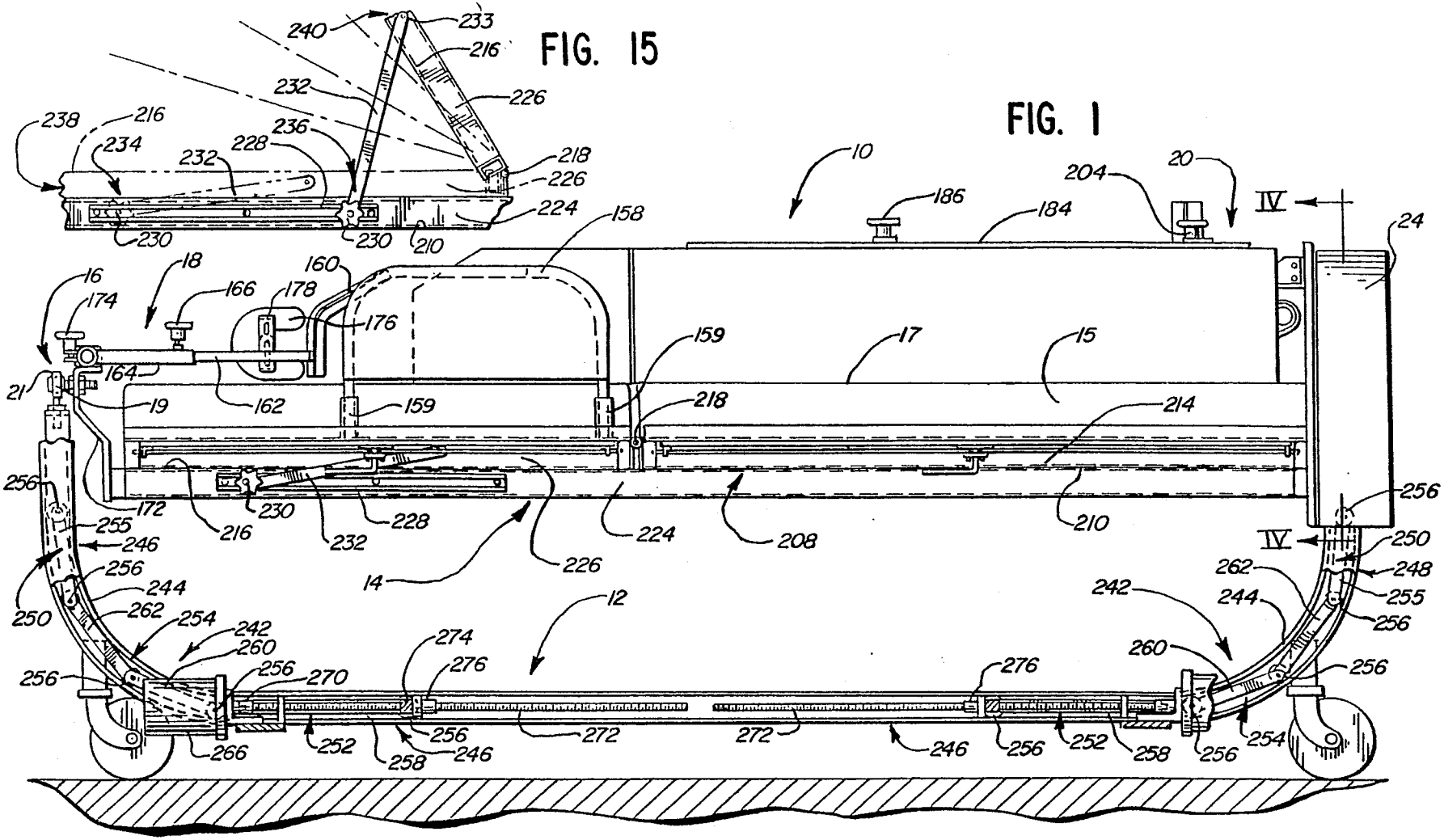
FIG. 1 is a side elevation of the therapeutic table of the present invention with a lower portion of the same partially broken away.
FIG. 15 is a side elevation of the adjustable support mechanism for altering the longitudinal tilt of the patient support of the therapeutic table.

As seen in FIG. 1, therapeutic table 10 includes substantially planar base frame 12 and a patient support 14 rotatably mounted to base frame 12. Patient support frame 14 includes padding 15 providing patient support surface 17 to support the patient.

Patient support frame 14 is rotatably mounted to base frame 12 by first connector assembly 16. First connector assembly 16 comprises a pivot axle or ball 19 received by a pivot connector mating socket 21 for relative universal movement therebetween, thereby providing a rotatable connection of head portion 18 of patient support 14 to base frame 12.

Figure 4:
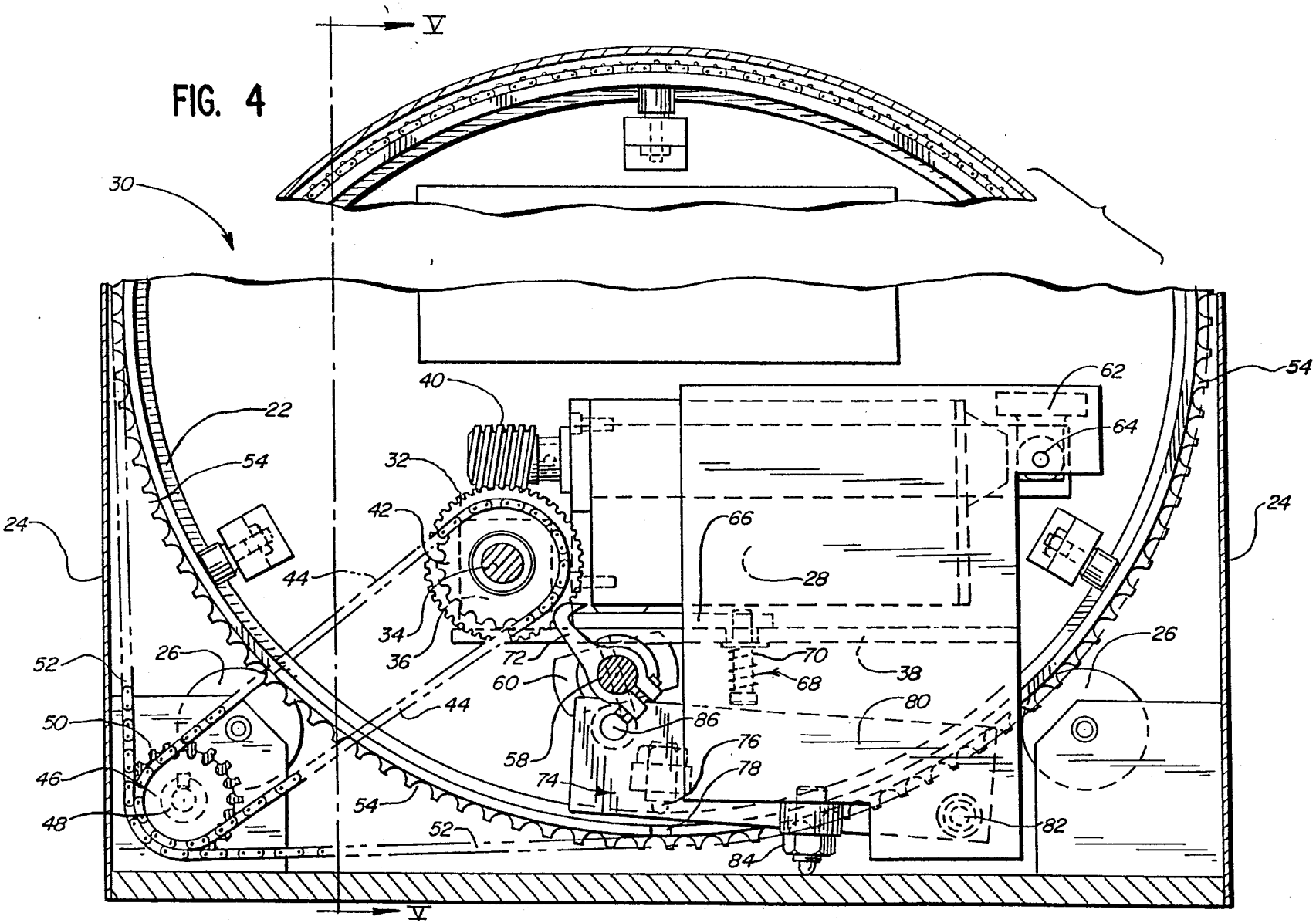
FIG. 4 is an enlarged partially broken cross-sectional view of the drive mechanism of the therapeutic table taken along view line IV—IV of FIG. 1.

Foot portion 20 of frame 14 has a second connector assembly including a circular drive ring 22, which can be seen in FIG. 4. Ring 22 is fixedly mounted to patient support 14 and is contained in drive housing 24. Mounting means, idler support wheels or roller members 26, as seen in FIG. 4, are rotatably mounted to frame 12. Ring 22 rests on roller members 26 providing underlying support of the circumference of ring 22 and permitting rotational movement of foot portion 20 with respect to frame 12 about an axis of rotation substantially aligned with first connector assembly 16, as seen in FIG. 1. The pivot axis of the therapeutic table 10 is defined by the first connector assembly 16 and the axis of rotation of ring 22. The center of gravity of the combined base frame 12 and patient support frame 14 is a preselected distance below the pivot axis. This distance is substantially reduced by adding a patient of average weight and, as a result, the total combined center of gravity is closely aligned to the pivot axis.

Figure 5:
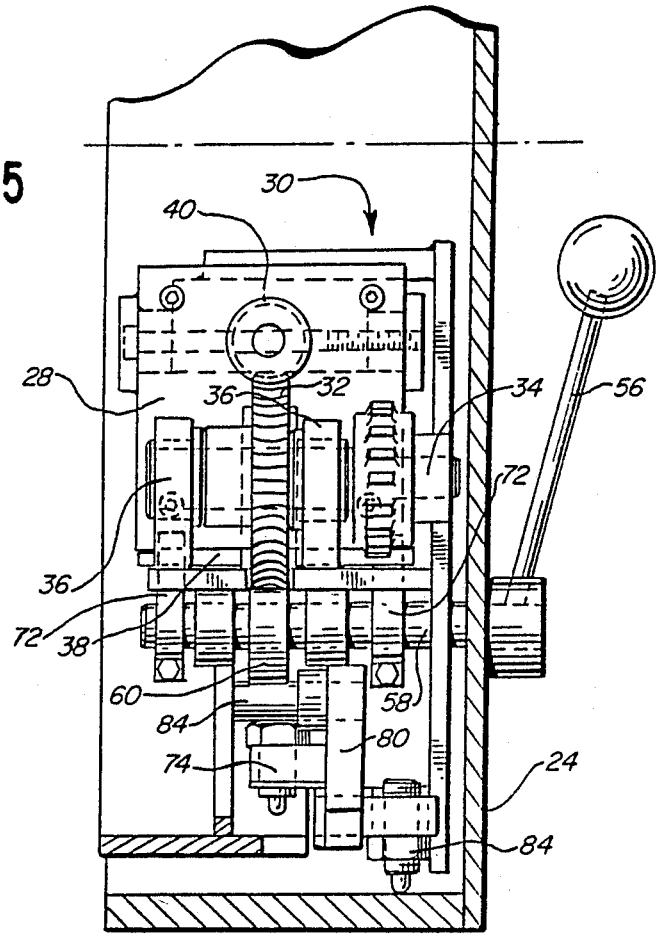
FIG. 5 is a partially broken cross-sectional side view of the drive mechanism taken along view line V—V in FIG. 4 including housing and hand lever arm.
Figure 7:
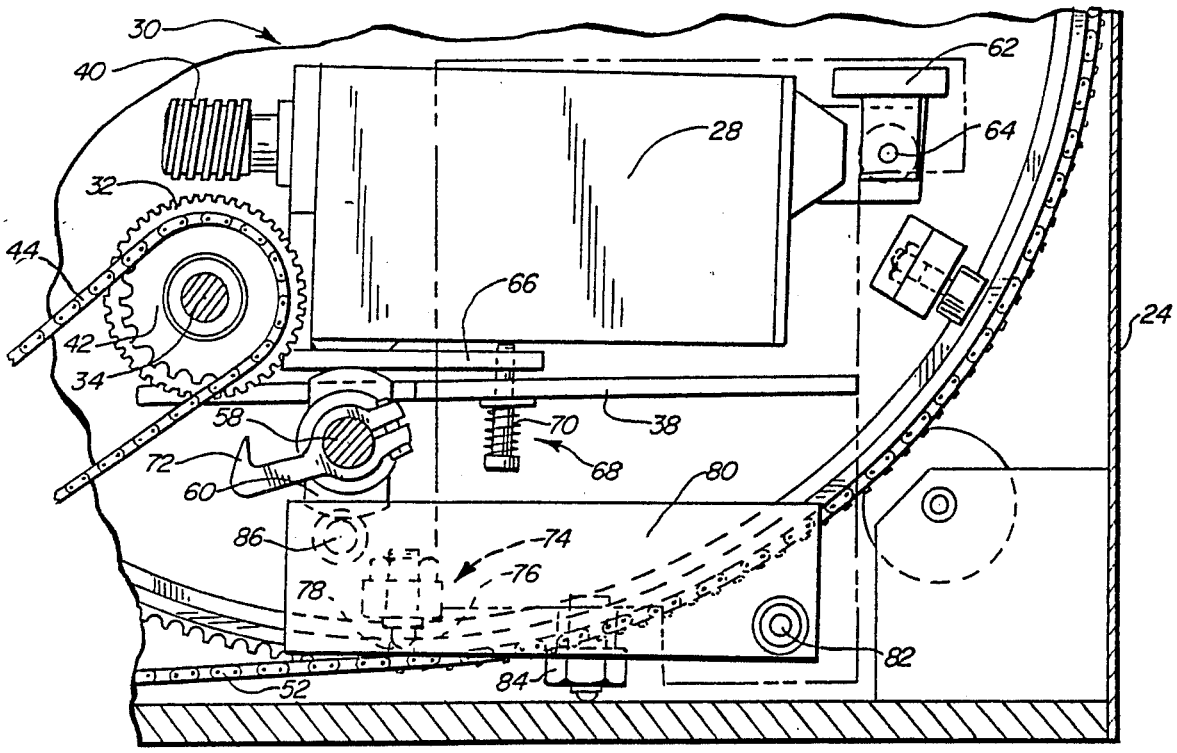
FIG. 7 is a partially broken view of the drive mechanism similar to that of FIG. 4 but with the drive mechanism disengaged.

Therapeutic table 10 has improved driving means 30 which provides power to rotate patient support 14. Driving means 30, as seen in FIGS. 4, 5 and 7, includes electric motor 28 which in turn rotates worm gear 40 and, in turn, gear or sprocket 32 which is in rotative engagement therewith. Sprocket 32 is linked to drive ring 22 providing a power transmitting means, as described in more detail below, for rotating patient support 14 between selected angular positions as desired for optimum treatment of the patient.

The linkaqe between sprocket 32 and drive ring 22 or power transmitting means includes sprocket 32 mounted to shaft 34 which is rotatably mounted to shaft frame 36. Shaft frame 36 is fixedly attached to platform 38 which, in turn, is fixedly interconnected to base frame 12. When sprocket 32 is engaged to worm gear 40 of electric motor 28 shaft 34 is rotatably moved. Sprocket 42 being fixedly attached to shaft 34, in turn, rotates. Drive chain 44 engages sprocket 42 and a similar transmission sprocket 46. Transmission sprocket 46 is fixedly mounted to rotatable shaft 48. Rotatable shaft 48 is rotatably mounted to housing 24. Thus, as drive chain 44 rotates transmission sprocket 46, rotatable shaft 48 rotates transmission sprocket 50 which is fixedly attached to shaft 48. Transmission sprocket chain 52 is engaged to gear teeth 54, disposed on the circumference of circular drive ring 22 and to transmission sprocket 50. As a result of the rotation of transmission sprocket 50, circular drive ring 22 rotates supplying rotational movement to patient support 14.

Drive ring 22 has a diameter on the order of the width of patient support frame 14 to provide a substantial gear reduction relative to the driving means.

The improved drive control also includes means for moving electric motor 28 into engagement and disengagement with the above power transmitting means. As seen in FIG. 5, a hand operated lever 56 is mounted to shaft 58 which in turn has cam 60 fixedly attached thereto. As seen in FIGS. 4 and 5, electric motor 28 is pivotably connected to fixed frame 62 by pivot connector 64. Electric motor 28 rests upon movable motor platform 66. Movable motor platform 66 is movably mounted to platform 38 by spring connector 68.

Referring to FIG. 4, when worm gear 40, which is a unidirectional driving gear, is engaged with sprocket 32, movable motor platform 66 rests upon platform 38. Spring 70 of spring connector 68 is in a tension position supplying a downward force on worm gear 40, assisting engagement with sprocket 32. Further, assistance in maintaining engagement between worm gear 40 and sprocket 32 is provided by hooks 72 mounted to shaft 58. As seen in FIG. 4, hooks 72 push downwardly on movable motor platform 66, in turn, pulling worm gear 40 into sprocket 32.

When disengagement of worm gear 40 is desired, lever 56 is activated rotating cam 60, as seen in FIG. 7, removing hooks 72 from movable motor platform 66 and pushing movable motor platform 66 upwardly. This upward movement disengages worm gear 40 from sprocket 32 and removes the driving power to patient support 14.

Drive control assembly further includes a switch for terminating electrical power to electric motor 28. When power is terminated to electric motor 28, worm gear 40 remains engaged to sprocket 32 and because it is a unidirectional driving gear it holds patient support 14 in any position it was in when electric motor 28 stops. If desired, worm gear 40 may then be disengaged from sprocket 32, thereby releasing patient support 14 to be easily hand moved to a preselected position.

An often desired preselected position for patient support 14 is substantially horizontal. To lock patient support 14 into this position when worm gear 40 is disengaged from sprocket 32, locking means 74, as seen in FIG. 7, comprising a second locking element or spring loaded pin 76 engaging first locking element or aperture 78 defined in circular drive ring 22 is provided.

Means associated with the above described means for disengaging worm gear 40 to sprocket 32 is also provided. This associated means includes frame 80 pivotally mounted onto pin 82, as seen in FIGS. 4 and 7. Spring loaded pin 76 is mounted to frame 80, as shown in FIG. 5. A second spring loaded pin 84, as seen in FIG. 4, rests on housing 24 and biases frame 80 from housing 24. Associated means also provides bar 86 mounted to frame 80, as seen in FIGS. 4, 5 and 7. Bar 86 is positioned beneath cam 60.

When worm gear 40 is engaged with sprocket 32, second spring loaded pin 84 pushes bar 86 against cam 60. In this position, spring load pin 76 is positioned above and not in contact with circular drive ring 22. However, when worm gear 40 is disengaged from sprocket 32 by cam 60, as seen in FIG. 7, cam 60, at the same time, pushes downwardly on bar 86. Spring load pin 76, if not positioned directly over aperture 78, is then compressed into circular drive ring 22. Patient support 14 may be then easily hand moved until pin 76 aligns with aperture 78, at which point, pin 76 will self activate and engage aperture 78. Thus, attendant need not visually align pin 76 and aperture 78, but merely move patient support until pin 76 self engages aperture 78 and locks patient support 14 into desired position.

Figures 3, 3A:
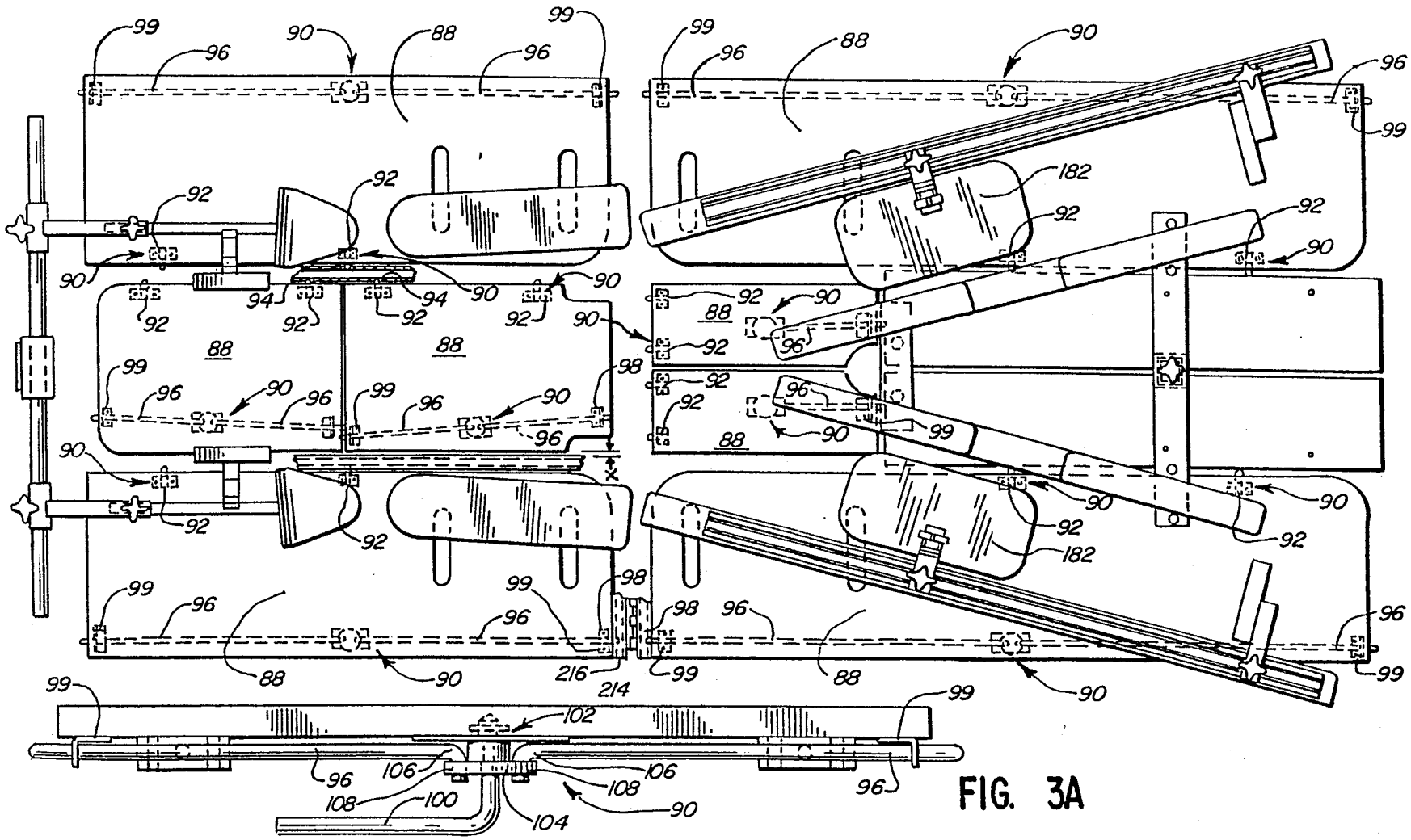
FIG. 3 is a top view of the therapeutic table without padding and the support frame partially broken away.
FIG. 3A is an enlarged side elevation of the improved mounting mechanism for the removable panels of the therapeutic table.
Figure 10:
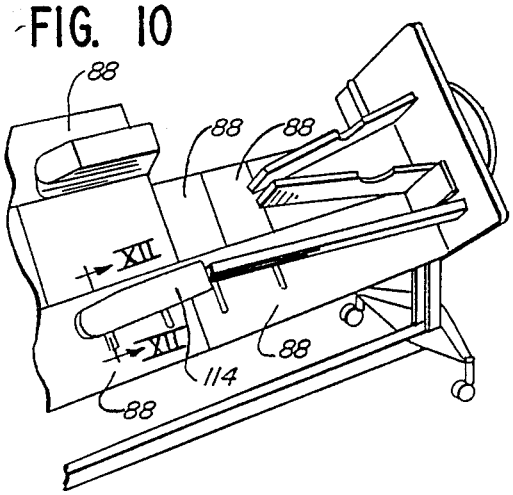
FIG. 10 is a perspective view of a portion of the therapeutic table in a tilted position and with one leg panel removed.

Therapeutic bed 10 provides completely removable panels 88, in patient support 14, as viewed in FIGS. 3 and 10. Panels 88, when removed, allow anterior access to the patient and permit a wide range of movement of specific patient limbs when desired.

Panels 88 are mounted to patient support 14 by an improved mounting mechanism 90, as seen in FIGS. 3 and 3A. Mounting mechanism 90 comprises a pair of spaced pins 92 which can be mounted to one side of panels 88 and received by receiving means or apertures 94 which can be located in patient support 14. Alternately, spaced pins 92 can be mounted to patient support 14 and apertures 94 can be located in panels 88. Either arrangement provide support of one end of panels 88. Another pair of movable pins 96 are mounted to panels 88, spaced apart and located on adjacent sides of panels 88 to where pins 92 are located. Pins 96 are supported by receiving means or apertures 98 in patient support 14. When pins 92 and 96 are received by their corresponding apertures 94 and 98, panels 88 are secured to patient support 14.

Movable pins 96 have means connected thereto to move pins 96 into and out of receipt with apertures 98. These means comprise bracket 99 for supporting pins 96 in sliding engagement with panels 88, seen in FIGS. 3 and 3A. Lever arm 100 is rotatably mounted to panel 88 by pivot connector 102. Bracket 104 is mounted to lever arm 100 and rotates when lever arm 100 is rotated. Pins 96 are mounted to bracket 104 by hook portions 106 of pins 96 received by openings 108 of bracket 104. Thus, simple hand turning of lever arm 100 rotates bracket 104 which slides pins 96 inwardly or outwardly, as desired. As a result, panels 88 can be easily removed from patient support 14 by removing movable pins 96 from apertures 98 by actuating lever arm 100 and sliding panel 88 away from frame 14 by maintaining grasp on lever arm 100.

Figure 2:
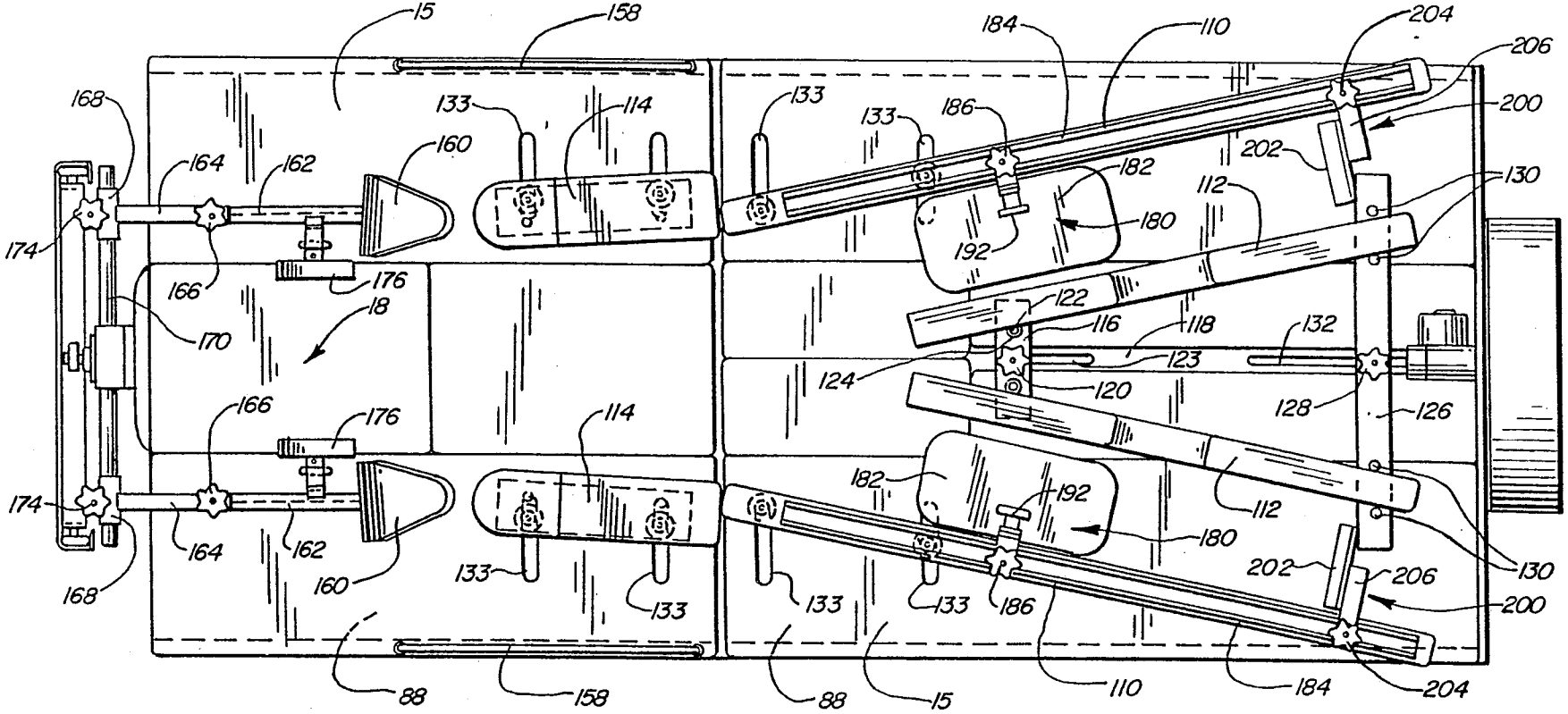
FIG. 2 is a top view of the therapeutic table.

Therapeutic table 10 provides an improved lateral support assembly for holding a portion of the patient's body against lateral movement in at least one direction. It is desired, to keep patient's legs in close proximity to outer leg support 110 and inner leg support 112, as seen in FIG. 2. This arrangement prevents any radical movement of the patient's legs when patient support 14 is rotating. Similarly, the patient's thoraxic portion of the body needs lateral support which is provided by thoraxic supports 114.

Figure 11:
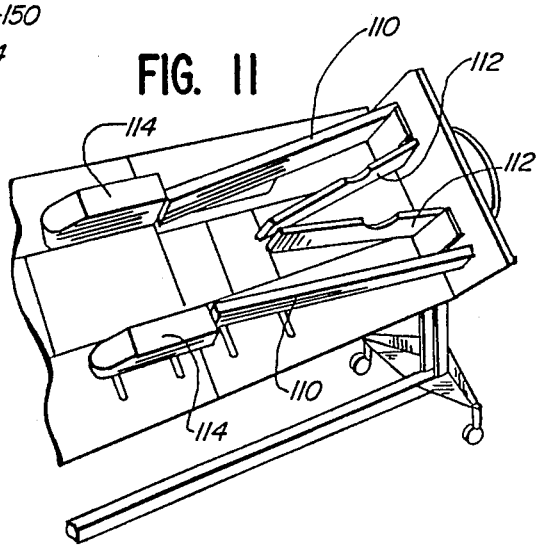
FIG. 11 is another perspective view of a portion of the therapeutic table in a titled position.

Since body dimensions vary from one patient to another, the distance between supports 110 and 112, as well as between supports 114, must be adjustable. As viewed in FIGS. 2 and 11, supports 110, 112 and 114 are elongated members which are substantially symmetric along a longitudinal central axis thereof. Supports 110, 112 and 114 are generally padded for contacting the patient's body.

As viewed in FIG. 2, inner leg supports 112 are adjustable by providing bracket 116 mounted to adjustment rail 118 by hand clamp 120. Vertical posts 122 are mounted to bracket 116 and engage ring members 124 that are mounted to inner leg supports 112. This engagement allows inner leg support 112 to be rotated about posts 122 when hand clamp 120 is secured in any desired position along opening 123 of adjustment rail 118. At the lower end of inner leg supports 112, bracket 126 is movably mounted to adjustment rail 118 by hand clamp 128. Bracket 126 has two pairs of vertical posts 130, mounted thereto. Each pair of posts 130 slidably hold inner leg support 112. Hand clamp 128 may be secured in any desired position along opening 132 of adjustment rail 118. Inner leg supports 112 can be moved closer together or further apart by positioning hand clamps 120 and 128 along adjustment rail 118.

Figure 12:
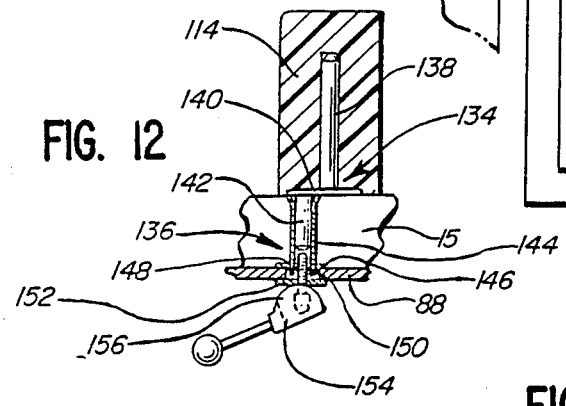
FIG. 12 is a cross-section of the improved lateral support assembly as taken along view line XII—XII of FIG. 10.

The improved lateral support assembly further includes the mounting of outer leg supports 110 and thoraxic supports 114. In FIG. 2, slots 133 are provided through padding 15 and panels 88. In FIG. 12, mounting member 134 is attached to a support member, i.e., outer leg or thoraxic, at one end and engaged to attaching means 136 in slot 133 at the other end.

Mounting member 134 comprises a post 138 mounted substantially vertical and substantially in the longitudinal axis of support 114. Connector plate 140 attaches connection portion or post 142, offset laterally and in a downward direction, to post 138. Post 142 is received by attaching means 136.

Attaching means 136 includes tube 144 disposed in slot 133 which slidably receives post 142. The lower end of tube 144 is mounted to foot plates 146 which transverse slot 133, and on the inner portion of the lower end of tube 144 is mounted threaded collar 148. Threaded collar 148 threadingly receives threaded member 150. Threaded member 150 projects through slot 133 and through bearing plates 152 which transverse slot 133. Lower portion of threaded member 150 has cam lever 154 rotatably attached thereto. Cam lever 154 has a cam surface 156 of varying radii of curvature which contacts bearing plates 152.

With this improved lateral support assembly outer leg and thoraxic supports 110 and 114, respectively, may be adjustably moved to fit the patient's body in two ways. First, attaching means 136 may be moved along slot 133 to a desired position and locked. The releasing or locking of attaching means 136 occurs by moving cam lever 154. Moving cam lever 154 in one direction pushes camming surface 156 onto bearing plates 152, which creates a downward pulling force on threaded member 150 clamping foot plates 146 to panel 88. Moving cam lever 154 in the opposite direction causes camming surface 156 to be removed from bearing plates 152 thereby removing a downward pulling force on foot plates 146. This permits mounting member 134 and attaching means 136 to be moved along slot 133. Secondly, outer leg supports 110 can be interchanged with each other. This will place supports 110 closer or further away from the outside portion of patient support 14 because of the offset construction of mounting member 134. Similarly, this can be done with outer leg supports 110.

As viewed in FIG. 2, positioned at the outside edge of patient support 14 and across from each thoraxic support 114 is rail 158. Rail 158 prevents the arms of the patient from moving off of patient support 14. Rails 158 are slidingly received by receptacles 159 for easy mounting and removal of rails 158, as seen in FIG. 1.

Adjustable shoulder supports 160, as seen in FIGS. 1 and 2, are mounted by telescopic tubes 162 and 164. Tubes 162 and 164 slide into and out of each other and can position shoulder supports 160 horizontally where desired and locked by clamp 166. Shoulder supports 160 are positioned just above the patient's shoulders to prevent a severely injured patient from inadvertently sitting up.

Tube 164 is fixedly mounted to collar 168, as seen in FIG. 2. Collar 168 is rotatably attached to cross bar 170. In turn, cross bar 170 is fixedly mounted to bracket 172 of patient support 14. Clamps 174 are provided on collars 168 to secure or release, as desired, collars 168 for rotational movement to cross bar 170. This construction allows each shoulder support 160 to be individually rotated toward or away from patient as needed.

Lateral head supports 176, as seen in FIGS. 1 and 2, are provided, particularly, for patients that will be in head traction. Lateral head supports 176 are adjustable horizontally along tube 162 by typically a screw clamp. Lateral head support 176 is also adjustable vertically in relation to tube 162. Typically this vertical adjustment is accomplished by a screw clamp which is received by a slotted bracket 178 which holds lateral head support 176 to tube 162. Since lateral head supports 176 are mounted to tube 162, supports 176 can be individually rotated up and away from or down and toward the patient as the shoulder supports 160 described above.

Figure 8:
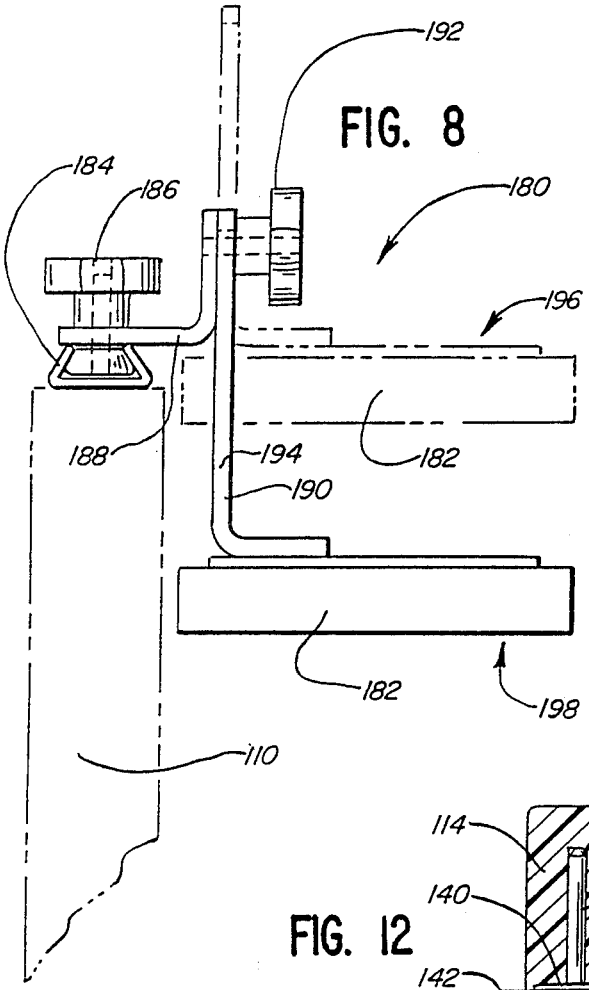
FIG. 8 is an enlarged end view of the knee support assembly of the therapeutic table.

In FIGS. 2 and 8, is shown an improved knee restraint 180 which includes knee restraint member 182 movably mounted to outer leg support 110. Outer leg support 110 has means for mounting to patient support 14 as described earlier.

Knee restraint member 182 is generally needed to be positioned in close proximity over the patient's knee joint. Therefore, knee restraint member 182 is mounted to outer leg support 110 for horizontal adjustment over patient support 14 and easy access by attendant. Means for mounting member 182 to support 110 comprises track 184 disposed in an upper portion or surface of outer leg support 110 and hand clamp 186 carried by track 184. Hand clamp 186 has bracket 188 attached thereto, as viewed in FIG. 8. In turn, bracket 188 has adjustable bracket 190 attached thereto by hand clamp 192 to which knee restraint member 182 is fixedly attached. Hand clamp 186 can be loosened to slide the knee restraint assembly horizontally over patient support 14 to the desired location and then tightened.

Knee restraint member 182 is placed vertically in close proximity to patient's knee by loosening hand clamp 192 and sliding adjustable bracket 190 along slot 194 defined therein. Knee restraint member, for example, can be moved from first position 196, as seen in FIG. 8, to a second position 198. When knee restraint member 182 is in a desired vertical position, hand clamp 192 is then secured thereby firmly securing adjustable bracket 190 to bracket 188.

Figure 9:
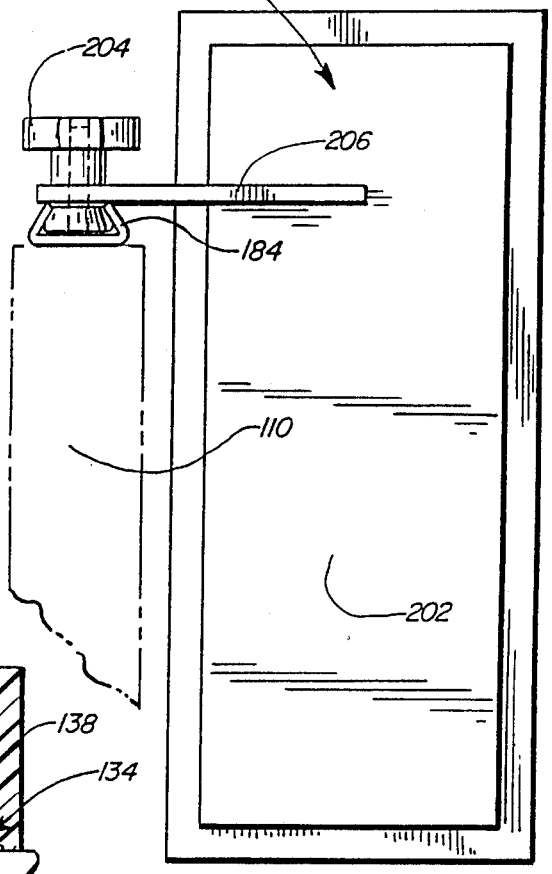
FIG. 9 is an enlarged end view of the foot support assembly of the therapeutic table.

In FIGS. 2 and 9, is shown an improved foot support assembly 200 comprising foot support member 202 movably mounted to outer leg support 110 for easy attendant access. Outer leg support 110 has means for mounting to patient support 14 as described earlier.

Foot support member 202 is generally positioned to abut the lower portion of the patient's foot. Therefore, foot support member 202 has means for mounting to outer leg support 110 for horizontal adjustment over patient support 14. This mounting means includes track 184 disposed in an upper portion or surface of outer leg support 110 and hand clamp 204 carried by track 184. Hand clamp 204 has bracket 206 attached thereto, as seen in FIG. 9. In turn, bracket 206 is fixedly attached to foot support member 202. Hand clamp 204 can be loosened to slide foot support member horizontally over patient support 14 to the desired location and tightened.

In FIGS. 1, 13, 14 and 15, is shown a means for raising a patient to a sitting up position and lowering the same to a prone position.

Figures 13, 14:
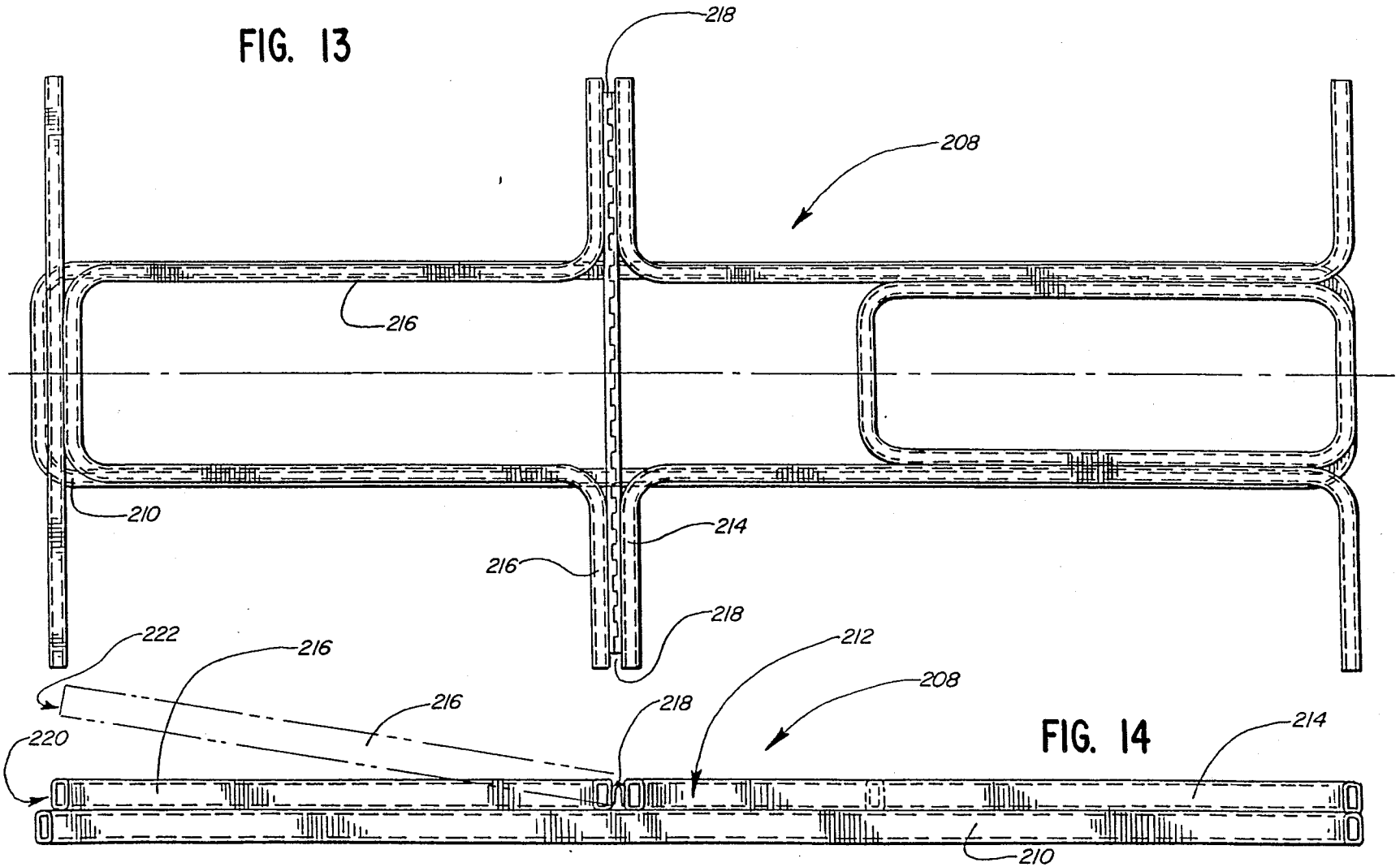
FIG. 13 is a top view of the patient support frame of the therapeutic table.
FIG. 14 is a side elevation of the patient support frame of FIG. 13.

In FIGS. 13 and 14, is shown a double-hinged support frame 208. Frame 208 is shown as part of the lower portion of patient support 14 in FIG. 1.

Frame 208 has a lower rigid frame 210 and an upper-hinged frame 212 mounted thereto. Foot end 214 of hinged frame 212 is fixedly attached to lower frame 210. Head end 216 of hinged frame 212 is hinged to foot end 214 by hinges 218. Thus, head end 216 can be rotated, as seen in FIG. 14, for example, between a first position 220 and a second position 222.

In FIGS. 1 and 15, is shown the mechanism for raising and lowering as well as locking head end 216 of frame 208. Railing 224 is attached to the exterior side portion of lower rigid frame 210, as seen in FIG. 1. Similarly, railing 226 is attached to the exterior side portion of the head end 216 of upper-hinged frame 212. Track 228 is mounted to railing 224, as shown in FIGS. 1 and 15. Hand clamp 230 is carried in track 228 and at the same time, is pivotally connected to lever arm 232. Lever arm 232 is pivotally connected at its other end to railing 226 by pivot connection 233. This described mechanism is also identically located on the opposite side of therapeutic table 10.

As a result of this mechanism, the patient can be easily raised and secured in numerous sitting up positions, as well as, lowered to a prone position. For example, in FIG. 15, hand clamp 230 can be loosened from track 228 in its first position 234 and pushed along track 228 to a second position 236. This movement of hand clamp 230 causes lever arm 232 to raise the head end 216 from a first position 238 to a second position 240. At this point, hand clamp 230 can be tightened to secure head end 216 in desired second position 240. Similarly, this process is reversed and head end 216 can be lowered and secured.

Improved adjustable patient support mounting assembly 242 can be seen in FIGS. 1 and 6. Assembly 242 includes base frame 12 having tracks 244 disposed along its lower portion. Tracks 244 have a horizontal portion 246 and an upturned portion 248. First element 250 is movably mounted to the upturned portion 248, and second element 252 is, likewise, movably mounted to horizontal portion 246. Means 254 is located substantially in tracks 244 for flexibly linking first and second elements 250 and 252.

First element 250 comprises bar 255 having a wheel 256 rotatably and pivotally mounted to each end of bar 255. Similarly, second element 252 comprises bar 258 having a wheel 256 rotatably and pivotally mounted to each end of bar 258. Means 254 found between first and second elements 250 and 252 is similarly bars 260 and 262, as seen in FIG. 1, each of bars 260 and 262 are rotatably and pivotally mounted to a wheel 256 located at each end of said bars. Bars 255, 260, 262 and 258 are successively pivotally linked at a wheel 256, as viewed in FIG. 1. Wheels 256 are disposed in tracks 244 and allow this flexible linkage to move along horizontal portion 246 and upturned portion 248 of track 244.

Assembly 242 provides a driving means 264 for second element 252 which includes electric motor 266. Electric motor 266 has a drive shaft 268 joined to threaded drive shaft 272 by mating cylinder or coupling 270. Cross shaft 274 is fixedly mounted to second elements 250 and, likewise, fixedly attached to ball screw 276. Ball screw 276 is substantially parallel to horizontal portion 246 and ball screw 276 along with coupling 270 are located between tracks 244. Ball screw 276 is threadingly engaged to shaft 272. When electric motor 266 is activated, shaft 272 rotates in one direction causing ball screw 276 to travel along shaft 272. As a result, second element 250 is moved along track 244. When electric motor 266 is activated in the reverse direction, shaft 272 rotates in this reverse direction causing ball screw 276 to travel along shaft 272 in the opposite direction as first described. When electric motor 266 is turned off, ball screw 276 holds its position on shaft 268.

As seen in FIG. 6A, first elements 250 are pivotally connected to frame 278. Frame 278 has mating socket 21 of connector assembly 16 mounted to the top portion of frame 278. Thus, when electric motor 266 is activated, head portion 18 of patient support 14 is raised or lowered to place the patient in various Trendelenburg positions.

The above described adjustable patient support mounting assembly 242 is, likewise, located at the opposite end of frame 12 which is the same end as foot portion 20 of patient support 14. The only difference between this assembly and the previously described assembly is that the corresponding first element 250 being third element is mounted to the foot portion 20 of patient support 14 by connecting means. The remainder of the apparatus corresponds to that which was described above such as second element 252 is fourth element etc.

The two above described adjustable patient support mounting assemblies 242 work independently of one another. Thus, head portion 18 of patient support 14 can be raised and lowered as desired by actuating electric motor 266, and foot portion 20 can so, likewise, be raised and lowered by activating electric motor 280.

Figure 16:
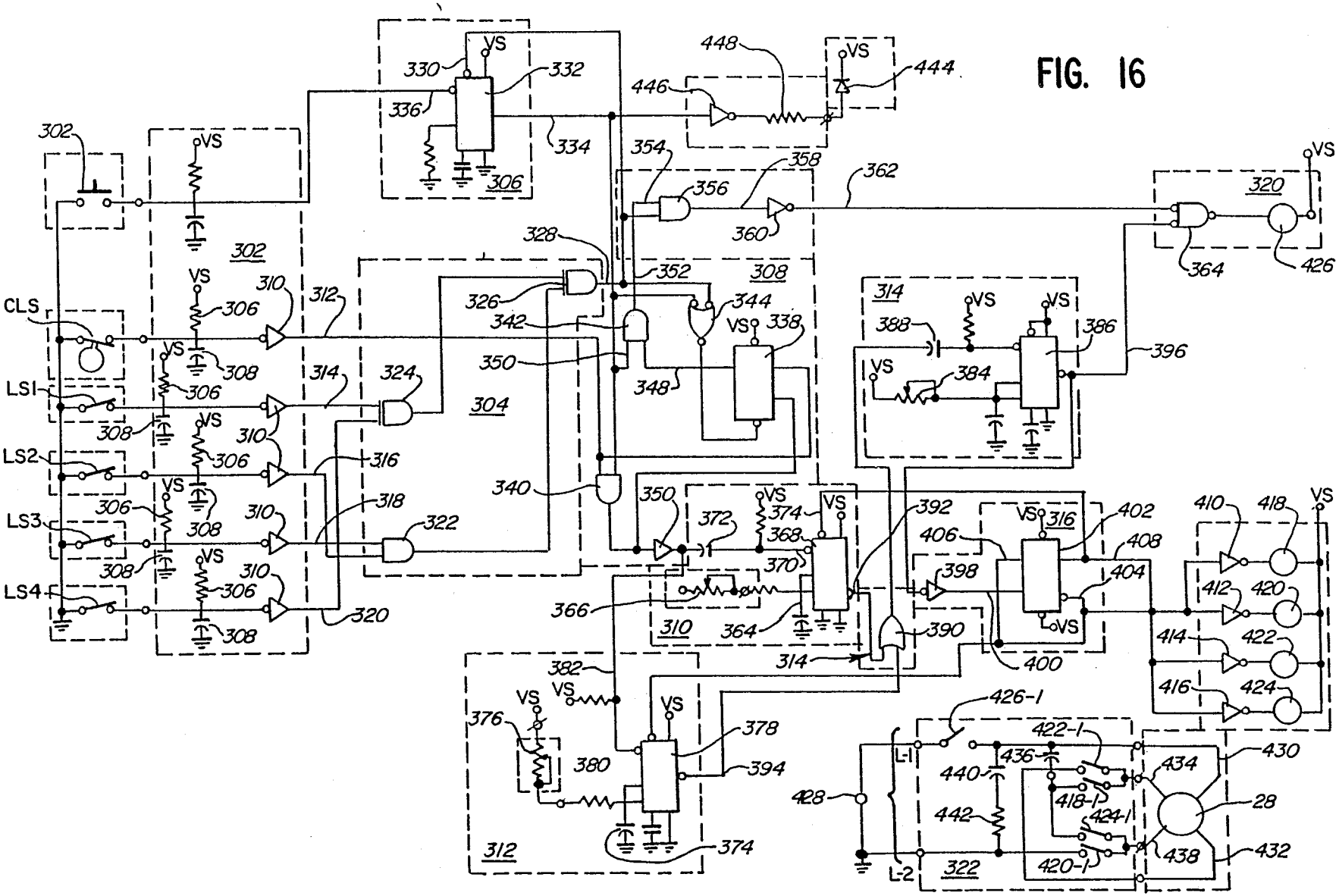
FIG. 16 is a schematic circuit diagram of the motor control circuit of the therapeutic table.

The movement of the patient support is controlled by a motor control circuit shown in FIG. 16. Generally, the control circuit operates as follows. After limit switches LS1 through LS4 and CLS are closed and a start switch 300 is closed, the bed will start to tilt to the right for a time period set by a tilt right potentiometer which will be described hereinafter. When the timer period lapses, a stop timer is activated which stops all motion for a set period of time by terminating power to the motor. After the stop timer period has lapsed, a direction control logic circuit changes the direction of the motor, and the patient support will return toward a zero point, or horizontal position. As it crosses the zero point, the limit switch CLS will close and trigger a tilt left timer. The patient support will then tilt to the left for a time period set by a tilt left potentiometer. When this time period has lapsed, the stop timer is triggered, and the motor again stops. After the stop timer period lapses, the direction logic circuit will again change the rotary direction of the motor which causes the patient support to return to the zero point. After the patient support crosses the zero point, the above cycle is repeated, so long as power is applied to the system. Advantageously, the time periods are selectively variable to selectively alter the degree of maximum tilt of the patient support. If at any time the rotation limits are exceeded, or if the head or foot of the bed is raised, at least one of limit switches LS1, LS2, LS3 and LS4 will open to cause termination of electrical power to the motor. If the patient support is not in its horizontal position, the control circuit will not allow the motor to start.

Referring to FIG. 16, the electrical motor control circuit has thirteen functional subcircuits, as follows: an input switch debouncing circuit 302, a limit switch logic circuit 304, a start latch circuit 306, a zero detect and crossing logic circuit 308, a tilt left timer circuit 310, a tilt right timer circuit 312, a stop timer circuit 314, a direction control logic circuit 316, a direction relays and drivers circuit 318, a motor control relay and drivers circuit 320, a motor direction and snubber circuit 322, an on indicator circuit 324 and a power supply circuit (not shown). The operation of these circuits are described below in the order listed.

In the input switch debouncing circuit, all external switches 302, CLS, LS1, LS2, LS3 and LS4 have one side connected to ground, so that when they are switched to a closed position, as shown, a logic 0-state signal is produced on the other side of the switch. Each of the other sides of these switches are connected to identical debouncing circuits to prevent the adverse effect of contact bounce. Each of the debouncing circuits comprises a capacitor 306 connected to ground and a resistor 308 with one side connected to the switch and capacitor 306 and the other side connected to a positive power supply voltage VS, such as 5 volts DC. This results in production of a logic 1-state signal at the juncture of resistor 306 and 308 whenever the associated switch is open. Each of the outputs of switches CLS, LS1, LS2, LS3 and LS4 are connected to the input of an associated inverting Schmidt trigger 310 to provide additional noise immunity. These Schmidt triggers 310 produce logic 1-state signals on their outputs 312, 314, 316, 318 and 320 when the associated switches are closed.

These outputs 312–320 are connected to the limit switch logic circuit 304. They are logically conjuncted by means of AND gates 322, 324 and 326. The output of AND gate 326 produces a 1-state signal on its output 328 when all of the limit switches are in a closed position, as shown, indicating a safe condition for operation. In the event that any one of the limit switches is open, the AND gate 328 will produce a 0-state signal on its output to prevent operation.

The output 328 is connected to a reset input 330 of a timer circuit 332 configured as a latch. A trigger input 336 of timer circuit 332 is connected to the momentary contact start switch 302 through its associated debouncing circuit. The timer circuit 332 latches in response to a 0-state signal at its trigger input 336 to produce a logic 1-state signal on its output 334 so long as the reset input 330 is being provided with a logic 1-state enable signal. In the event the 1-state signal is removed from the reset input 330, such as occurs when any of the limit switches are opened, then the output 334 is switched to a logic 0-state to stop the motor.

In order for the application of electrical power to the motor to begin rotation of the patient support, the patient support must be in a horizontal position, as detected by the switch CLS. Switch CLS is a normally open switch held closed when the patient support is at a horizontal position. When this condition is met, a 1-state logic signal is developed on output 312 of circuit 302. This results in the development of a 1-state signal at the input of a flip-flop 338 of zero detect and crossing logic circuit 308 and at the input of an AND gate 340 of this same circuit. When the start switch 302 is actuated, a 1-state signal is developed at output 334 of circuit 306. This 1-state signal is also applied to the inputs of three AND gates 340, 342 and 344. The 1-state signal applied to the input of AND gate 340 causes its output to switch to a 1-st-ate which triggers the flip-flop 338 to cause its output 348 to also switch to a 1-state. The 1-state signal from AND gate 340 is also inverted by an inverter 350, and the resultant 0-state signal produced on the output of inverter 350 is supplied to and triggers the tilt left timer circuit 310 and the tilt right timer circuit 312.

As stated, the output 348 is also connected to an input of AND gate 342. When a 1-state signal is applied to AND gate 348 at the same time that a 1-state signal is applied to its other input 350 from output 334 of circuit 306, the output 352 of AND gate 342 switches to a 1-state. This 1-state signal is applied to an input 354 of an AND gate 356. The other input to AND gate 356 is coupled to output 334 of circuit 306, and if both inputs are in a logic 1-state, AND gate 356 switches its output 358 to a logic 1-state. The 1-state signal on output 358 is applied to an inverter 360 which inverts the 1-state signal and produces 0-state signal on its output 362. This 0-state signal is coupled to an OR gate 364 of the motor control relay and drivers circuit 320. Output 348 of flip-flop 338 will remain in a logic 1-state as long as output 328 of AND gate 326 and output 334 of circuit 306 remain in a logic 1-state. If at any time either of these outputs switch to a 0-state, then the flip-flop is cleared and an output 348 of flip-flop 338 switches to a 0-state. This causes the output 352 of AND gate 342 to switch to a 0-state. This, in turn, causes the output 358 of AND gate 356 to switch to a 0-state, and output 362 to switch to a 1-state.

The tilt left timer circuit 310 is used to generate a 1-state signal for a period of time determined by a capacitor 364 and a potentiometer 366. With a one megaohm potentiometer and a one hundred microfarad capacitor, the time period is variable from one to ninety seconds. This variable time period is established by a timer 368 which is triggered by a negative going pulse and its trigger input 370. This pulse is generated by a capacitor 372 connected in series with the output of inverter 350. Thus, the timer 368 is triggered by the start switch 302 or by detection of a zero crossing by means of the circuitry of start latch circuit 306 or zero detect and crossing logic circuit 308, as described above. The timer 368 is reset by means of a logic signal applied to its reset input 374 from the direction control logic circuit 316.

The tilt right timer circuit 312 is identical to the tilt left circuit 310 and functions in an identical fashion. It comprises a capacitor 374, a potentiometer 376, a timer 378 having an input 380 coupled to the output of inverter 350 through a capacitor 382. These elements respectively correspond to elements 364, 366, 368, 370 and 372 of the tilt left circuit 310 described above.

The stop timer circuit 314 stops the motor for a period of time determined by a potentiometer 384 for a variable time period between zero and ten seconds. This causes the patient support to come to a complete stop before changing directions. A timer 386 is triggered by a negative going pulse generated from a capacitor 388 connected in series with the output of an OR gate 390 which comprises the stop timer circuit 314. The inputs to OR gate 390 are respectively connected to the outputs 392 and 394 of the tilt left timer circuit 310 and the tilt right timer circuit 312. When both of these inputs to OR gates 390 are in 0-state, the output of OR gate 390 switches to a 0-state which is coupled through capacitor 388 to trigger timer 386. The output 396 of timer 386 is connected to an inverter 398 of direction control logic circuit 316. It is also connected to the other input of OR gate 364 of motor control relay and drivers circuit 320. The output of inverter 398 is connected to a clock input 400 of a flip-flop 402 of the direction control logic circuit 316.

The direction control logic circuit 316 comprises a D-type flip-flop having an inverting output 404 connected to its D input 406. In this configuration, the inverting output 404 and the non-inverting output 408 alternately switch between logic 1-states and logic 0-states with each clock pulse applied to input 400. The output 396 of stop timer 386 is connected to the clock input 400 through inverter 398. Accordingly, the flip-flop 402 is caused to change states in response to lapse of the timing period of the stop timer. Output 408 of timer 402 is coupled to the reset input 374 of timer 368 of the tilt left timer circuit 310. The output 406 of timer 402 is coupled to the reset input 374 of timer 368 of the tilt left timer circuit 310. When output 400 switches to a logic 0-state, one or the other of tiers 378 or 368 is triggered depending on which output 408 or 404 is in a logic 1-state.

The direction relays and driver circuit 318 comprises a plurality of inverters 410, 412, 414 and 416 which respectively drive coils 418, 420, 422 and 424. These relays are energized by a logic 0-state at their inputs and are commonly connected to DC power supply source VS. Relays 418 and 420 are associated with means for controlling the motor to cause the patent support to tilt right, and relay coils 422 and 424 are associated with relays which cause the patient support to tilt left. The inputs to inverters 410 and 412 are obtained from inverting output 404 of flip-flop 402. The inputs to inverters 414 and 416 are coupled to the non-inverting output 408 of flip-flop 402. Thus, either relay coils 418 and 420 are energized or relay coils 422 and 424 are energized, but all four coils are never energized at the same time.

The motor control relay and drivers circuit 320, as previously indicated, drives a relay coil 426. When relay coil 426 is energized, its associated relay switch 426-1 causes connection of AC power from a suitable source 428 to one side of relay contacts 422-1 and 418-1 respectively associated with relay coils 422 and 418 and to one side of relay contacts 424-1 and 420-1 respectively associated with relay coils 424 and 420. Thus, when relay coil 426 is energized, the motor 28 will operate in a rotary direction determined by the direction control flip-flop 402. If the relay coils 418 and 420 are energized, then relay contacts 422-1 and 418-1 are closed and the motor rotates in the direction to tilt the patient support to the right. On the other hand, if relay coils 422 and 424 are energized, then the motor will rotate in a direction to cause the patient support to tilt to the left. Relay coil 426 is energized when a 0-state signal is developed on the output of OR gate 364. As previously indicated, both inputs to OR gate 364 must be in a 0-state in order for a 0-state signal to be produced on its output. Thus, if a logic 1-state signal is produced on output 362 of the zero detect and crossing logic circuit 308, indicating that the patient support is not at a horizontal position, the motor will not be energized. Likewise, during the tie period of the stop timer 386, a logic 1-state signal applied to the input of OR gate 364 will prevent the motor from being energized. The motor direction and snubber circuit 322 functions to reverse the direction of the motor by reversing the connection of motor leads 430 and 432 in a well-known manner. Lead 430 is connected to the hot side of the AC power source 428 and the lead 432 is connected to the neutral, or cold, side of the AC power source 428. When the relay contacts 418-1 and 420-1 are closed, a lead 434 of motor 28 is connected to a capacitor 436 and a lead 438 is connected to the neutral side of AC power source 428. On the other hand, when relay contacts 422-1 and 424-1 are closed, lead 438 is connected to capacitor 436 and the hot side of AC power source 428, and lead 434 is coupled to the neutral side of AC power source 428. A capacitor 440 and a resistor 444 connected in series across the AC power supply 428 functions as a snubber.

The ON indicator circuit comprises an LED 444 which is energized when a 1-state signal is generated on the output 334 of start latch circuit 306. The 1-state signal on output 334 is inverted by an inverter 446 which drives the LED 444 through a resistor 448.

The power supply circuit for the control of FIG. 15 is not shown since it is of any conventional design. Preferably, it produces a regulated 5-volt DC supply as voltage supply voltage VS.

It should be understood that the above description is exemplary and variations may be made without departing from the scope of the invention defined in the following claims.

We claim:

1. In a therapeutic table having a frame and an elongate patient support mounted to the frame, an improved adjustable lateral support assembly for holding a portion of the patient's body against lateral movement in at least one direction, comprising:

an elongate lateral support member which is substantially symmetrical with respect to an elongate central axis thereof;

a mounting member attached to the lateral support member and having a connection portion at a location offset laterally from said central axis; and means for releasibly attaching the connection portion of the mounting member to the therapeutic table adjacent a side of the patient support.

2. The therapeutic table of claim 1 in which said attaching means is located adjacent a portion of the patient support for supporting the patient's torso.

3. The therapeutic table of claim 1 in which said attaching means includes means for slidable connective receipt of said mounting member.

4. The therapeutic table of claim 1 including a second mounting member attached to the support member and having a connection portion at a location offset laterally from the central axis, and second means for releasibly attaching the connection portion of either the first or second mounting member to the therapeutic table, said connection portion of the second mounting member spaced from the connection portion of said first mounting member in the elongate direction of the support member.

5. The therapeutic table of claim 1 in which the releasible attaching means is mounted to the frame beneath the patient support.

6. The therapeutic table of claim 1 in which said releasable attaching means includes a connector connectable to the connector portion, and means for adjustably mounting the connector to the bed at different lateral positions.

7. The therapeutic table of claim 1 including another lateral support assembly substantially identical to said first mentioned support assembly but with its releasable attaching means being located for mounting the connection portion of its mounting member adjacent another side of the patient support opposite that of the first mentioned lateral support assembly.

8. The therapeutic table of claim 7 in which the mounting member connection portion of the first mentioned lateral support assembly is compatible with the releasable attaching means of the other lateral support assembly for releasable connection therewith in place of the mounting connection portion of the other lateral support asemby and vice versa.

9. A method of adjusting the lateral spacing between a pair of elongate lateral support members mounted to a bed by means of releasable connectors laterally offset from a central elongate axis thereof, said support members having opposite inwardly and outwardly facing sides, comprising the steps of:

disconnecting the pair of lateral support members form the bed; and reconnecting them to the bed in the opposite positions that they were previously connected with their previously inwardly facing sides facing outwardly.

10. The method of claim 9 in which the sides of each of said lateral support members are symmetrically located with respect to said central axis.

* * * * *